United States Patent [19]

Lonow

[11] Patent Number: 4,768,657

[45] Date of Patent: Sep. 6, 1988

[54] DRYING RACK FOR SCUBA BOOTS AND GLOVES

[76] Inventor: Mark Lonow, 4111 Lincoln Blvd., #360, Marina del Rey, Calif. 90292

[21] Appl. No.: 43,851

[22] Filed: Apr. 29, 1987

[51] Int. Cl.[4] ..... A47F 7/08

[52] U.S. Cl. ..... 24/34; 211/113; 211/118

[58] Field of Search ..... 211/13, 34, 35, 36, 211/38, 189, 113, 118, 85; 223/85

[56] References Cited

U.S. PATENT DOCUMENTS

| | | | |
|---|---|---|---|
| 1,012,518 | 12/1911 | Cain . | |
| 1,556,425 | 10/1925 | Coombes . | |
| 2,192,167 | 3/1940 | Bagley et al. | 211/113 |
| 2,267,634 | 12/1941 | Arenz | 211/35 |
| 2,278,258 | 3/1942 | Gillett | 211/34 |
| 2,281,016 | 4/1942 | Barney | 34/21 |
| 2,469,481 | 5/1949 | Snyder | 211/118 |
| 2,546,600 | 3/1951 | Holden | 223/85 |
| 2,703,651 | 3/1955 | Brocklehurst | 211/34 |
| 2,939,588 | 7/1960 | Nalle, Jr. | 211/113 |
| 2,977,000 | 3/1961 | Sitzman | 211/34 |
| 3,478,942 | 11/1969 | English | 223/85 |
| 3,517,823 | 6/1970 | Papineau | 211/13 |
| 3,731,809 | 5/1973 | Saenger | 211/118 |
| 3,802,572 | 4/1974 | Shakel | 211/118 X |
| 4,007,861 | 2/1977 | Duester | 223/85 |
| 4,023,762 | 5/1977 | Batts | 248/359 |
| 4,364,496 | 12/1982 | Bridgeman | 211/113 X |
| 4,653,678 | 3/1987 | Blanchard et al. | 211/118 X |

FOREIGN PATENT DOCUMENTS

| | | | |
|---|---|---|---|
| 534 | of 1908 | United Kingdom . | |
| 2103081 | 2/1983 | United Kingdom | 211/34 |

*Primary Examiner*—Ramon S. Britts
*Assistant Examiner*—Sarah A. Lechok Eley
*Attorney, Agent, or Firm*—Spensley Horn Jubas & Lubitz

[57] ABSTRACT

A drying rack for scuba boots and gloves has a vertical support hanger and a horizontal platform. The platform contains oblong openings in which to insert scuba gloves. Extendings are provided, defining slots for hanging boots upside down. The extending arms are at an angle with the horizontal, including the boots so as to expel water therefrom.

11 Claims, 1 Drawing Sheet

DRYING RACK FOR SCUBA BOOTS AND GLOVES

BACKGROUND OF THE INVENTION

1. Field of the Invention

This invention relates to hangers for drying scuba equipment, and more specifically to racks for hanging and drying scuba boots and gloves.

2. Description of the Related Art

Customarily, scuba equipment is stored in a crate, box or similar confined area where all the constituent parts of a scuba suit are placed after use. This makes it difficult to find a specific piece of equipment, especially a smaller piece like a glove. Putting wet equipment in a box also impedes air circulation, making it difficult for the equipment to dry and for the water contained in the equipment to drain, thereby increasing the likelihood of mold and mildew setting in. The equipment also tends to deform when packed in a confined space.

Storing in a crate or box also makes it hard to display the scuba suit. This is exacerbated in places like scuba rental shops where large quantity of equipment must be kept. It is desirable in such a place to be able to hang and display a complete scuba suit in an orderly and attractive manner. It is also desirable that used scuba equipment dry relatively quickly, especially those items like boots and gloves.

It is therefore an object of this invention to provide a means for drying scuba boots and gloves.

Yet another object of this invention is to help ensure an efficient use of storage space by providing a means for easily sorting and displaying scuba boots, gloves and the like.

It is a further object of the invention to provide a user with a convenient, inexpensive and portable way of organizing scuba equipment so as to keep the different pieces of equipment together.

No previous invention has fully addressed all the above objectives. For example, Holden, U.S. Pat. No. 2,546,600 (1951) discloses a garment hanger which includes a body part formed with a number of slots. A garment is threaded through any two of the slots or through one of the slots and around one of the side edges, which thereby allows portions of the garment suspended from the device to be held in spaced relation with each other and thereby facilitate drying. The back part of the hanger is removable from the body part and is disposed within a slot formed in the central portion of the body part. However, this does not even identify the problems associated with hanging and drying scuba equipment, let alone provide a solution.

Brocklehurst, U.S. Pat. No. 2,703,651 (1955) discloses a device for hanging boots. However no means are provided for draining water out of the toe area. Likewise, no means are provided for drying gloves or for chaining hangers together so as to allow easy hanging and drying of an entire scuba suit.

Yet other prior art devices have similar shortcomings.

SUMMARY OF THE INVENTION

The drying rack of the present invention comprises a vertical support hanger with indentations forming support lips. On these support lips a generally horizontal drying platform is disposed. The platform has an opening through which the support hanger passes. The platform also has outwardly extending arms which define rectangular slots. The arms are configured to support scuba boots so that the toe area of the boots is higher than the heel area, allowing water inside the boots to readily drain. Oblong openings are also provided in the platform for scuba gloves. A glove can be positioned in one of the openings likewise allowing water inside the glove to readily drain.

An alternate embodiment contemplates two separate drying platforms—one for boots, one for gloves—stacked one above the other. In this embodiment, the platforms are supported at different levels on an associated support hanger.

The novel features which are believed to be characteristic of the invention, both as to its organization and method of operation, together with further objectives and advantages thereof, will be better understood from the following description considered in connection with accompanying drawings in which two alternate embodiments of the invention are illustrated by way of example. It is to be understood, however, that the drawings are for purposes of illustration and description only and are not intended to be a definition of the limits of the invention.

DESCRIPTION OF THE INVENTION

The following description is of the best presently contemplated mode of carrying out the invention. The description is made for the purpose of illustrating the general principles of the invention and should not be taken in a limiting sense. The scope of the invention is best determined by reference to the accompanying claims.

Figure 1:
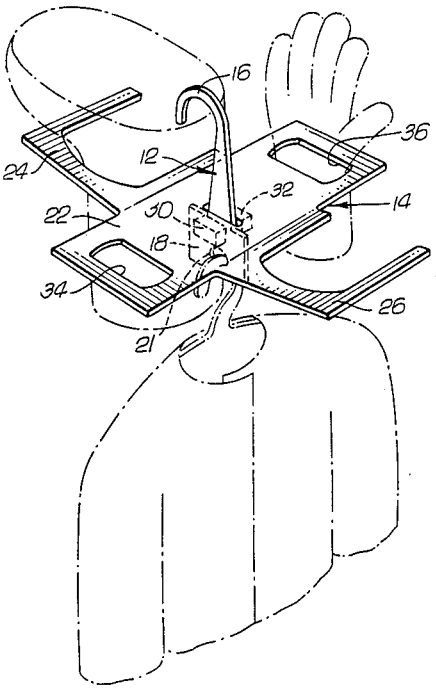
FIG. 1 is a perspective view of the preferred embodiment of this invention illustrating the support hanger and the drying platform.
Figure 2:
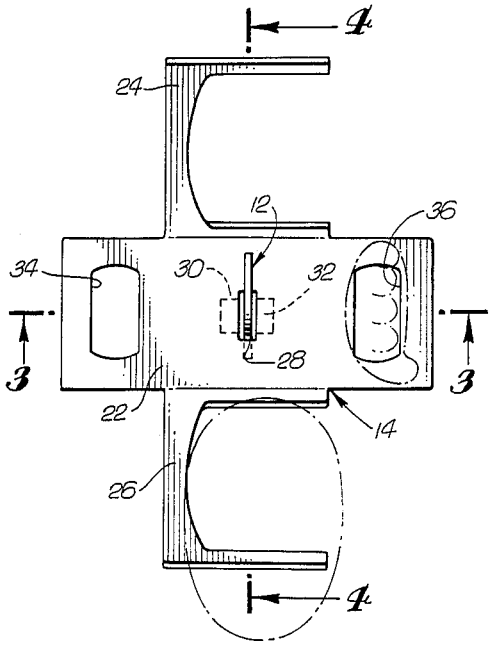
FIG. 2 is a top view of the support hanger of the invention.

Referring to FIGS. 1 and 2, the preferred embodiment comprises a generally vertical support hanger 12 and a generally horizontal drying platform 14. The hanger consists of a hook 16 and a depending support portion 18. As can be seen, the support portion 18 has indentations defining a generally flat support lip area 20. The support portion 18 is of long rectangular shape and also defines a centrally located hole or opening 21. The opening 21 provides a means to hang other portions of the scuba equipment as illustrated in phantom line. For example, a wet suit—the body garment part of a scuba gear—can be placed on an ordinary wire hanger and the hook portion passes through the opening 21. This enables an entire scuba outfit to be hung. Alternatively, another hanger 12 can be suspended, allowing for a chain of boot and glove hangers. That arrangement is particularly useful for display or storage purpose in a store.

The support hanger 12 is preferably thin so as to provide ease of storage when not in use. It can be made of plastic of any other similar rigid material. Although a hook and support lips are described, it is understood that similar suspending and positioning means are covered by this invention.

Figure 3:
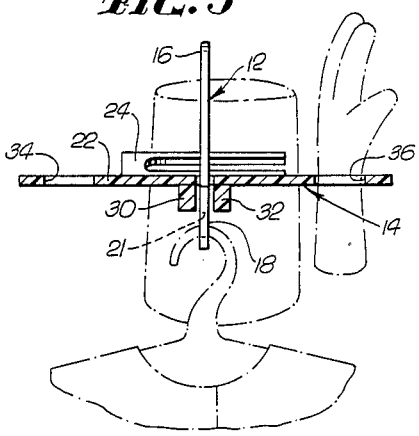
FIG. 3 is a cut-away view of the drying platform of the invention illustrated in FIG. 2 taken along lines 3—3.
Figure 4:
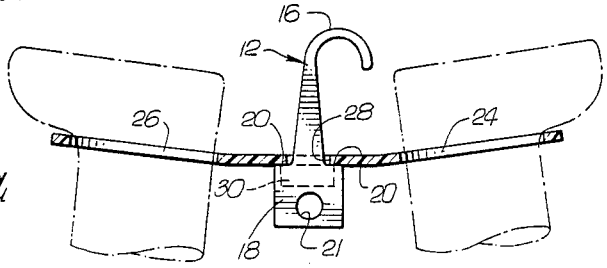
FIG. 4 is a cut-away view of the drying platform of the invention illustrated in FIG. 2 taken along lines 4—4.

Referring to FIGS. 2, 3 and 4, one can see that the platform has a generally rectangular central section 22 with outwardly extending arms 24, 26. The central section 22 has a centrally located rectangular opening 28. The support hanger 12 is inserted into the rectangular opening 28 and is pulled through until the platform 14 rests on the support lip area 20. To stabilize the platform 14 in a horizontal position, two generally rectangular stabilizers 30 and 32 are provided on opposite sides of the rectangular opening 28. The stabilizers 30, 32 position the portion 18 that is protruding underneath the platform 14 so as to prevent movement of the platform 14 with respect to the support hanger 12. It is also understood that equivalent stabilizing means are covered by this invention.

On opposite sides of the central opening 28, two oblong slots 34, 36 are defined by the platform 14. Slots 34, 36 are arranged and configured such a scuba gloves can be readily secured to the platform 14. More specifically, glove can be inserted through the oblong slot, for example slot 34, with the fingers pointing upward and the glove opening downward. The slots thus allow water to readily drain out of the glove, and air to circulate inside, facilitating drying.

In the preferred embodiment, arms 24 and 26 are articulated with the central section 22. Each arm bends upward from the central section 22 with the angle between the arm and the central plate of approximately 10°. Each arm defines a generally rectangular slot to receive a boot. The boot is inserted into the slot with the toe portion facing away from the central section and the sole facing upward. The angle of the arm allows water inside the boot to drain away from the toe portion and out of the boot.

The device thus allows for a pair of scuba boots, a pair of gloves and an optional wet suit to be hanged from the same hook. This represent an economical, attractive and effective way to display and dry scuba equipment.

When not in use, the drying platform 14 can be removed from hanger 12 and stored flat thus economizing space.

Figure 5:
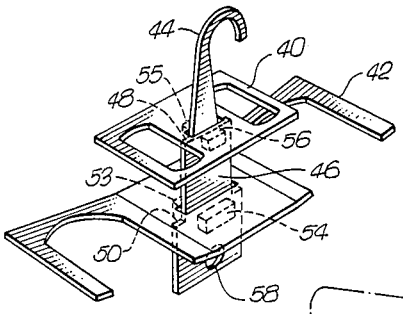
FIG. 5 is a perspective view of an alternate embodiment of the support hanger and drying platform.

As illustrated in FIG. 5, an alternate embodiment of the invention contemplates two generally rectangular platforms. Platform 40 is for gloves while platform 42 is for boots.

In this embodiment the device consists of the two platforms and a support hanger 44. As shown in FIG. 5, the support hanger 44 has a support portion 46 defining two support lip areas: a narrower lip area 48 and a wider lips area 50.

Although the order of the platforms is not important, for purpose of illustration, the boot platform 42 is hung on a lower level than the gloves platform 40. Each platform has a central opening, although the first rectangular opening 51 of the boots platform 42 is larger than the rectangular opening 52 of the gloves platform. This allows the boots platform to bypass the narrower lip area 48 and to come to rest on the wider lip area 50. Rectangular stabilizers 53 and 54 on opposite sides of the support hanger 44 positions the platform 42 so as to maintain a generally horizontal position. Two stabilizers 55 and 56 perform the same function for the gloves platform 40, which comes to rest on the narrower lip area 48.

The gloves platform 40 is a flat plate defining two oblong slots on opposite sides of the central opening. As in the first embodiment, the boots platform 42 has a central flat section and two extending arms articulated with the central section at an angle of approximately 10°. The extending arms define rectangular slots into which boots can be inserted upside down. The arms maintain the toe area of the boots in a higher position than the heel area, allowing water to readily drain out.

The device also incorporates a opening 58 in the support portion 46 for hanging additional racks. Thus a multilevel rack is provided allowing different body parts to be hanged from one hook, and boots and gloves to dry efficiently.

It should be understood that while the preferred example herein deal with rectangular shapes, other configurations can be used using the same principles. Terms such as "flat" should be understood to embody slightly curved surfaces as well. The number of platforms that can be supported should also not be considered restricted to two. It will be apparent to one skilled in the art that other modifications can be made without departing from the spirit or scope of the present invention as defined and claimed therein.

I claim:

1. A drying rack for scuba equipment, comprising:

(a) a first support hanger having a suspending means, means for supporting a drying platform, and means for joining a second support hanger beneath said first support hanger so as to form a chain; and (b) a drying platform joined to said support hanger such that said supporting means supports said drying platform in a generally horizontal position, said platform defining first and second slots, said slots for hanging scuba gloves with the opening of the gloves directed downward, said platform also having a plurality of arms extending upwardly from the horizontal portion defining slots for hanging scuba boots in a generally upside down configuration.

2. The drying rack of claim 1 further comprising stabilizing means for stabilizing movement of the support hanger relative to the drying platform said stabilizing means abutting the support hanger and the platform.

3. A drying rack comprising:

(a) a first thin vertical hanger member comprising:

a hook;

a generally rectangular member, joined to said hook, having a plurality of indentations, said indentations forming a support lip area said rectangular member further having an opening through which a second hanger can be passed, forming a chain of hangers;

(b) a generally horizontal platform comprising:

a horizontal central section having a central opening through which said first vertical hanger member extends and rests on said support lip area, and two slots configured to receive scuba gloves;

two outwardly extending arms joined to the central section, each arm defining a slot to receive a scuba boot; and (c) means abutting the platform and the first hanger member for stabilizing the platform and the first hanger member.

4. The drying rack of claim 3 wherein said arms define generally rectangular slots bending upward from the horizontal central section.

5. A drying rack for scuba boots and gloves comprising:

(a) a first thin vertical hanger member comprising:

a hook;

a generally rectangular member, joined to said hook, having a plurality of indentations, said indentations forming first and second lip support areas, said rectangular member further having an opening, through which a second hanger can be passed, forming a chain of hangers;

(b) a first generally horizontal platform having an opening at the center through which said first vertical hanger member extends, said first platform resting on said first lip support area, said first platform configured to support scuba gloves in a drying mode;

(c) a second generally horizontal platform with a smaller rectangular opening than the first platform such that the second platform rests on the second lip support area, said second platform having outwardly extending arms defining a plurality of slots for hanging scuba boots; and (d) means disposed on each of the platforms for stabilizing the platforms with respect to the first hanger member.

6. The drying rack of claim 5 wherein the arms form an angle of 10° with respect an associated platform.

7. The drying rack of claim 5 wherein the arms define generally rectangular slots with respect to the second platform.

8. A drying rack for scuba equipment, comprising:

(a) a support hanger having means for suspending said drying rack, and means for supporting a drying platform;

(b) a drying platform joined to said support hanger such that said supporting means supports said drying platform in a generally horizontal position said platform comprising a central generally horizontal section and outwardly extending arms bending upward from the generally horizontal central section; and (c) means for stabilizing the drying platform in a generally horizontal position.

9. The drying rack of claim 8 wherein the suspending means comprises a hook located generally at a first end of the support hanger.

10. The drying rack of claim 9 wherein the supporting means comprises a generally rectangular support portion located generally at a second end of the support hanger said support portion defining support lips adapted to engage the drying platform.

11. The drying rack of claim 8 wherein the means for stabilizing comprises generally rectangular stabilizers integrally attached to the drying platform and adapted to abut the support hanger so as to prevent movement of the drying platform relative to said support hanger.

* * * * *